United States Patent [19]

Nelle et al.

[11] Patent Number: 4,946,112

[45] Date of Patent: Aug. 7, 1990

[54] WINDING APPARATUS

[75] Inventors: Friedrich Nelle, Stuttgart; Heinz Lehner, Obserschneiding; Klaus Nitzsche, Straubing, all of Fed. Rep. of Germany

[73] Assignee: Nokia Graetz, Pforzheim, Fed. Rep. of Germany

[21] Appl. No.: 326,296

[22] Filed: Mar. 21, 1989

[51] Int. Cl.[5] ..... H01J 9/236

[52] U.S. Cl. ..... 242/7.14; 29/605

[58] Field of Search ..... 242/7.03, 7.06, 7.07, 242/7.14, 7.15, 7.16; 29/605, 606; 140/92.1, 92.2

[56] References Cited

U.S. PATENT DOCUMENTS

| | | | |
|---|---|---|---|
| 4,093,132 | 6/1978 | Christiana et al. | 242/7.03 |
| 4,157,165 | 6/1979 | Bierman et al. | 242/7.14 X |
| 4,217,937 | 8/1980 | Ache et al. | 242/7.13 X |
| 4,417,698 | 11/1983 | Pernet et al. | 242/7.14 X |
| 4,469,285 | 9/1984 | Fahrbach | 242/7.14 |

FOREIGN PATENT DOCUMENTS

| | | | |
|---|---|---|---|
| 57-23451 | 6/1982 | Japan . | |
| 61-30942 | 2/1986 | Japan | 242/7.03 |
| 62-126617 | 6/1987 | Japan | 242/7.07 |
| 1334295 | 8/1987 | U.S.S.R. | 242/7.03 |

*Primary Examiner*—Katherine A. Matecki

*Attorney, Agent, or Firm*—Peter C. Van Der Sluys

[57] ABSTRACT

A winding apparatus, for winding saddle coils for deflection units of picture tubes, has a wire guide tube that is movable along the contour of the desired windings in three mutually perpendicular planes. A receiving device for the coil form is rotatable about its longitudinal axis. In another embodiment the coil form remains stationary and the wire guide tube has one end angled at 90° and rotatable about its longitudinal axis.

3 Claims, 3 Drawing Sheets

WINDING APPARATUS

This is a divisional of copending application Ser. No. 109,074, filed on Oct. 16, 1987, and now abandoned.

BACKGROUND OF THE INVENTION

1. Field of the Invention

The present invention relates to an apparatus for winding saddle coils and more particularly to such an apparatus having a wire guide tube.

2. Description of the Prior Art

Saddle coils are used in deflection units on cathode-ray tubes for horizontal deflection of the electron beam. They frequently consist of individually series-connected strands which lie in grooves of a coil form. They may also consist of windings which are placed in a form provided with suitably shaped receiving portions and are later baked to form a self-supporting saddle coil. If the planes of the strands do not pass through the center of the coil form, the winding process can no longer be performed with conventional winding apparatus from a given inclination of the strands.

SUMMARY OF THE INVENTION

An object of the present invention is to provide a winding apparatus with which saddle coils of any shape can be wound quickly.

The present invention contemplates a winding apparatus having a wire guide tube for winding saddle coils. The wire guide tube is movable in three mutually perpendicular planes along the contour of the turns to be wound. A device for receiving the coil form is rotatable about its longitudinal axis.

In a particular embodiment the wire guide tube has one end angled at about 90° and is rotatable about its longitudinal axis. In this embodiment rotation of the coil form is no longer necessary.

DESCRIPTION OF THE PREFERRED EMBODIMENT

Figure 1:
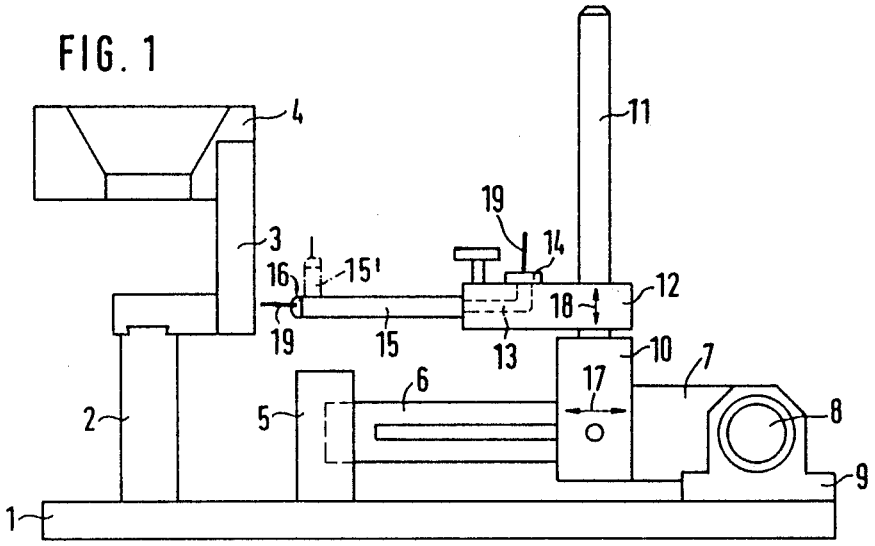
FIG. 1 is a schematic side view of an apparatus for winding saddle coils.
Figure 2:
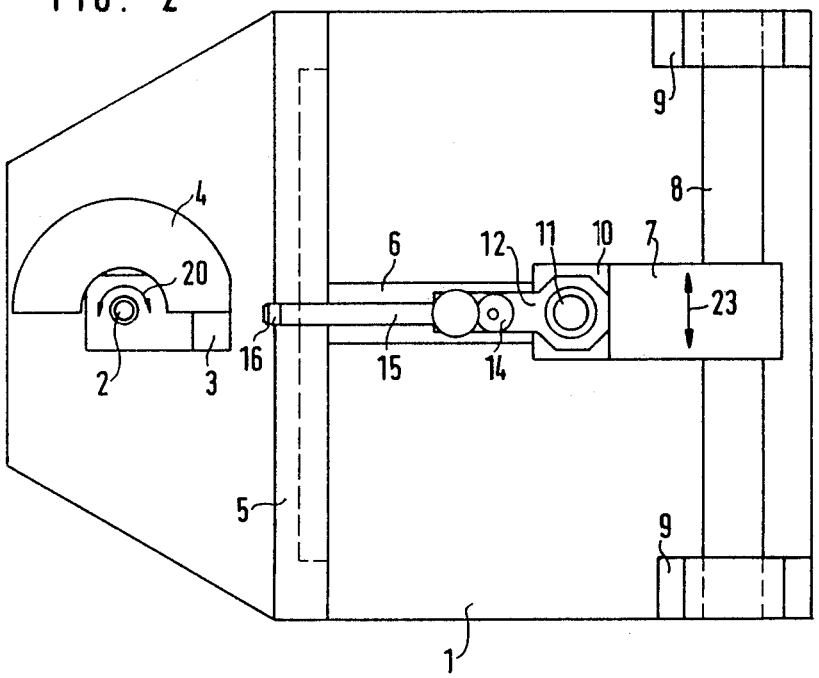
FIG. 2 is a top view of the apparatus of FIG. 1.

Referring to FIGS. 1 and 2 a base plate 1 supports a pillar 2 whose upper end bears a supporting arm 3 having a receiving device 4 for a coil form (not shown) attached thereto. Beside this, the base plate 1 supports a mechanism which can be moved in three mutually perpendicular planes. This mechanism includes a support 5 for a horizontal bar 6, whose other end is mounted in a slide 7. The slide 7 can slide on another horizontal bar 8, which is disposed at right angles to the bar 6. The bar 8 is connected with the base plate 1 via two supports 9. A mount 10 capable of sliding along the bar 6 holds a vertical bar 11 on which a holding device 12 can slide.

For the wire 19, the holding device 12 has a channel (indicated by broken lines) 13 with an inlet member 14 at one end and a horizontal wire guide tube 15 at the other. The free end of the wire guide tube !5 has an outlet member 16 attached thereto. The inlet and outlet members correspond to devices commonly used for such purposes.

The supporting arm 3 with the receiving device 4 can rotate about the longitudinal axis of the pillar 2. The slide 7 and, thus, the bar 6 can move along the bar 8, i.e., perpendicular to the plane of the paper in FIG. 1. The mount 10 is movable along the bar 6 in the direction of the double-headed arrow 17. The holding device 12 can be moved along the bar 11 in the direction of the double-headed arrow 18. The three motions are mutually at right angles, so that the outlet member 16 can be moved to any point in the space defined by the planes of motion.

Driving devices necessary for these motions are not shown in the schematic representation for the sake of clarity. For the same reason, only short pieces of wire are shown at the inlet member 14 and the outlet member 16, and no wire reel is shown.

FIG. 2 clearly shows the possible motion of the slide 7 along the bar 8; this motion is indicated by the double-headed arrow 23. It is also apparent that the support 5 extends over the entire width of the base plate 1 and has a receiving portion for the end of the bar 6 in the area opposite the bar 8. The movement of the holding arm 3 with the receiving device 4 about the longitudinal axis of the pillar 2 is indicated by the curved double-headed arrow 20.

The winding process will now be described with the aid of FIGS. 3 to 6, in which only a coil form 21 with its grooves 22 for receiving the wire 19 is shown to illustrate the process more clearly.

Figure 3:
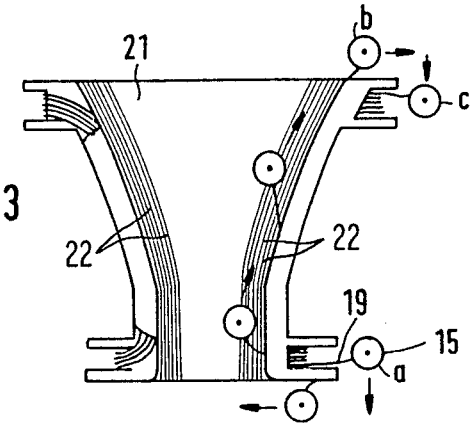
FIG. 3 shows a coil form partially cut away and the path of a wire guide tube along a groove in the coil form.

FIG. 3 shows the coil form 21 in a side view and the path of the wire guide tube 15. From its initial position a, the wire guide tube 15 moves downwards, then along the lower rim of the coil form 21, and subsequentlY upwards to a position in front of the groove 22 into which the wire is to be placed, the motion being indicated in the figure by arrows. The wire guide tube then moves upwards and to the right until it reaches the position b above the upper rim of the coil form. From there, it moves to the right and then downwards to the position c corresponding to the position shown in FIG. 4*a*.

Figure 4A:
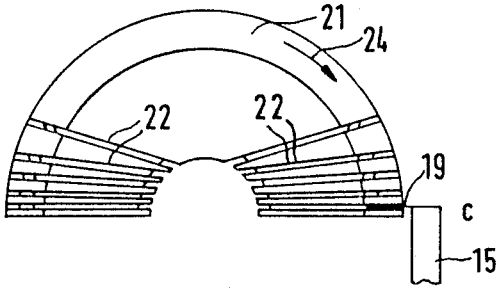
FIGS. 4*a* to 4*d* show the rotation of the coil form for winding an upper winding head.

FIG. 4*a* shows the coil form 21 in a top view and the wire guide tube 15 in position c. The coil form 21 is now rotated clockwise (arrow 24) by 180°, with the wire 19 being placed into a groove, shown clearly in FIG. 3, running parallel to the upper rim. At the end of this operation, the position shown in FIG. 4*c* is reached.

Figure 4B:
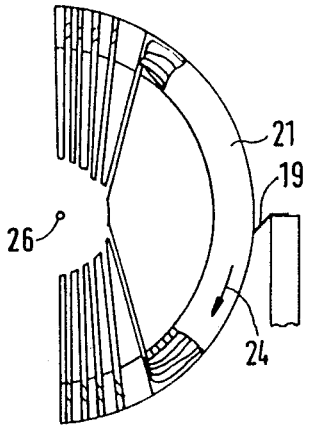
Figure 4C:
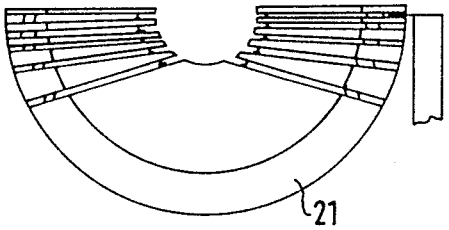

FIG. 4*b* shows the coil form 21 with a rim partly cut away to reveal the wires lying in the groove therebelow. This figure also shows that the planes of the grooves 22 and, thus, the planes of the desired strands of the saddle coil do not pass through the center 26 of the coil form 21.

The wire guide tube then moves upwards, i.e., out of the plane of the paper as shown in FIG. 4, and the coil form 21 is rotated counterclockwise (arrow 25) by 180°. At the same time, the wire guide tube moves to the left until it reaches the position d shown in FIG. 4*d*.

Figure 5:
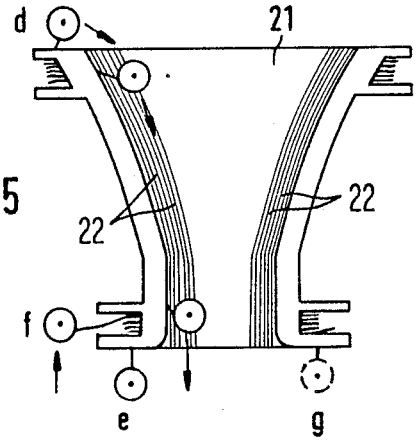
FIG. 5 shows the path of the wire guide tube along another groove.
Figure 4D:
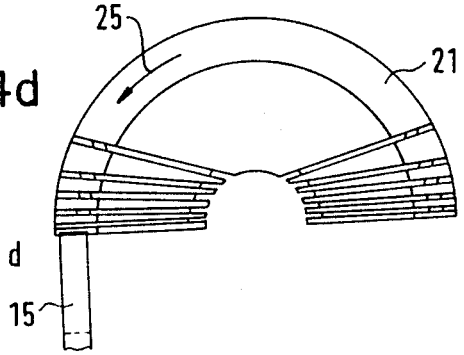

In FIG. 5, the position d of the wire guide tube and the coil-form position of FIG. 4*d* are shown in a side view. The wire guide tube now moves downwards until it reaches the position e. From there, it moves to the left and then upwards until it reaches the position f to the side of the groove running parallel to the lower rim of the coil form. In this position, the coil form 21 is rotated counterclockwise by 180°, with the wire 19 being laid into the groove. The wire guide tube then moves back to the position designated e, and the coil form is rotated back clockwise by 180°, with the wire guide tube moving to the right until it reaches the position g (indicated by a broken line) This position is approximately equal to the initial position, and the next turn is wound in similar fashion When the first groove 22 has been filled, the wire guide tube moves from its initial position to a position in front of the next groove and performs the winding process as described above.

If use is made of a wire guide tube 15, with an angled end as indicated by broken lines in FIG. 1, the need to rotate the coil form 21 during the winding process is eliminated. The winding of saddle coils with an angled wire guide tube will be described in the following.

Figure 6:
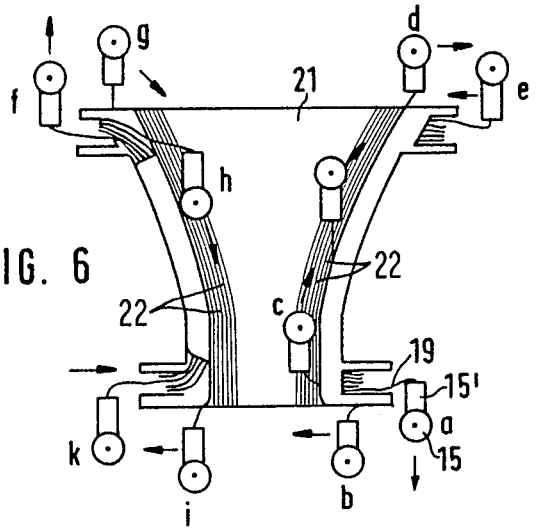
FIG. 6 shows a coil form partially cut away and the path of an angled wire guide tube during the winding of the saddle coil.

FIG. 6 shows the path of the angled wire guide tube during the winding of the saddle coil. The wire guide tube is in its initial position a, the angled end pointing upwards. It moves via position b to position c. On the way from position b to position c, the wire guide tube rotates clockwise about its longitudinal axis by 180°, so that the angled end points downwards. After reaching position e via position d, the wire guide tube moves to the left to position f, with the coil form 21 remaining in the position shown in FIG. 6. On the way from position f via position g to position h, the wire guide tube rotates clockwise about its longitudinal axis by 180°, so that its angled end points upward in position h. Via position i, the wire guide tube moves to position k. From there, it moves to the right and returns to position a, i.e., its initial position. Thereafter, the next turn is wound as described above.

What is claimed is:

1. An apparatus for winding a saddle coil on a coil form having a central axis and preformed grooves in which said coil is to be wound, said grooves being formed in both interior and exterior surfaces of said coil form, said apparatus comprising:

a device for supporting the coil form;

a wire guide tube having an axis disposed in a plane perpendicular to the central axis of the coil form and having a wire outlet disposed at an angle of about 90° from the axis of the wire guide tube and rotatable about the axis of the wire guide tube;

means for rotating said wire outlet about the axis of the wire guide tube; and means for linearly moving said wire guide tube in three directions orthogonal to each other, one of said directions being parallel to the central axis of the coil form, and for operating in co-operation with the means for rotating said wire outlet so that the wire outlet moves along paths defined by said grooves, whereby any point in the space defined by the maximum linear movement of the outlet of the wire guide tube can be reached by the wire outlet, and the wire outlet is positionable adjacent to the coil form and movable along the contours of the turns to be wound in the grooves of the coil form.

2. An apparatus for winding a saddle coil on a coil form having a central axis, interior and exterior surfaces, said surfaces terminating in upper and lower rims, preformed grooves formed in both the interior and exterior surfaces, said grooves including an upper groove running parallel to the upper rim on the exterior surface of the coil form, a lower groove running parallel to the lower rim on the exterior surface of the coil form, and a plurality of grooves formed on the interior surface of said coil form, said grooves extending from the lower rim to the upper rim and lying in planes parallel to the central axis of said coil form but not passing through said central axis, said apparatus comprising:

a device for supporting the coil form;

a wire guide tube having an axis disposed in a plane perpendicular to the central axis of the coil form and having a wire outlet disposed at an angle of about 90° from the axis of the wire guide tube and rotatable about the axis of the wire guide tube;

means for rotating said wire outlet about the axis of the wire guide tube; and means for linearly moving said wire guide tube in three directions orthogonal to each other, one of said directions being parallel to the central axis of the coil form, sand for operating in co-operation with the means for rotating said wire outlet so that the wire outlet moves along paths defined by the maximum linear movement of the outlet of the wire guide tube can be reached by the wire outlet, and the wire outlet is positionable adjacent to the coil form and movable along the contours of the turns to be wound in the grooves of the coil form.

3. An apparatus for winding a saddle coil on a coil form having a central axis and preformed grooves in which said coil is to be wound, said grooves being formed in both interior and exterior surfaces of said coil form, said apparatus comprising:

a device for supporting the coil form;

a wire guide tube having a first part extending along an axis disposed in a plane perpendicular to the central axis of the coil form and having a second part disposed at an end of the first part at an angle from the axis of the first part and rotatable about said axis, said second part forming a wire outlet for the wire guide tube;

means for rotating the second part about the axis of the wire guide tube; and means for linearly moving said first part in three directions orthogonal to each other, one of said directions being parallel to the central axis of the coil form, and for operating in co-operation with the means for rotating said second part so that the wire outlet moves along paths defined by said grooves, whereby any point in the space defined by the maximum linear movement of the first part of the wire guide tube and defined by the rotating movement of the second part of the wire guide tube can be reached by the wire outlet, and the wire outlet is positionable adjacent to the coil form and movable along the contours of the turns to be wound in the grooves of the coil form.

* * * * *

UNITED STATES PATENT AND TRADEMARK OFFICE

CERTIFICATE OF CORRECTION

PATENT NO. : 4,946,112

DATED : August 7, 1990

INVENTOR(S) : F. Nelle et al

It is certified that error appears in the above-identified patent and that said Letters Patent is hereby corrected as shown below:

At column 4, line 27, please delete "sand" and insert --and-- ; and at column 4, line 29, after "by", please insert --said grooves, whereby any point in the space defined by--.

Signed and Sealed this

Eleventh Day of February, 1992

*Attest:*

HARRY F. MANBECK, JR.

*Attesting Officer*

*Commissioner of Patents and Trademarks*